US009394893B2

(12) United States Patent
Mäder et al.

(10) Patent No.: US 9,394,893 B2
(45) Date of Patent: Jul. 19, 2016

(54) OSCILLATING SLIDE MACHINE THAT PUMPS DIFFERENT FLUID MEDIUMS AT DIFFERENT PRESSURES

(75) Inventors: André Mäder, Hildburghausen (DE); Christian Richter, Steinbach (DE); Mark Tepler, Schleusingen (DE); Bernd Morthorst, Braunschweig (DE); Jens Struckmann, Braunschweig (DE); Wolfgang Vöge, Braunschweig (DE)

(73) Assignee: Mahle International GmbH (DE)

( * ) Notice: Subject to any disclaimer, the term of this patent is extended or adjusted under 35 U.S.C. 154(b) by 469 days.

(21) Appl. No.: 13/581,316

(22) PCT Filed: Feb. 17, 2011

(86) PCT No.: PCT/EP2011/052352

§ 371 (c)(1),
(2), (4) Date: Nov. 12, 2012

(87) PCT Pub. No.: WO2011/104163

PCT Pub. Date: Sep. 1, 2011

(65) Prior Publication Data

US 2013/0052070 A1 Feb. 28, 2013

(30) Foreign Application Priority Data

Feb. 26, 2010 (DE) ..... 10 2010 009 471
Apr. 7, 2010 (DE) ..... 10 2010 014 137
Jun. 18, 2010 (DE) ..... 10 2010 024 222

(51) Int. Cl.
*F04B 23/10* (2006.01)
*F01C 21/08* (2006.01)
(Continued)

(52) U.S. Cl.
CPC ..... *F04B 23/10* (2013.01); *F01C 21/0809* (2013.01); *F04B 23/12* (2013.01); *F04C 11/005* (2013.01); *F04C 2/336* (2013.01)

(58) Field of Classification Search
CPC ..... F01C 21/0809; F04B 23/10; F04B 23/12; F04C 11/005; F04C 2/336; F04C 2240/20; F04C 2/332; F04C 2/348; Y10T 74/18056
USPC ..... 418/173, 172; 74/25
See application file for complete search history.

(56) References Cited

U.S. PATENT DOCUMENTS 2,064,635 A 12/1936 Stern
6,074,189 A 6/2000 Eckerle
2006/0191360 A1* 8/2006 Beez ..... F04C 2/348 74/25

FOREIGN PATENT DOCUMENTS

DE 3913414 A1 10/1990
DE 4434430 A1 3/1996
(Continued)

OTHER PUBLICATIONS

English Machine Translation of DE19532703 C1 (translated on May 8, 2015).*
(Continued)

*Primary Examiner* — Kenneth Bomberg
*Assistant Examiner* — Paul Thiede
(74) *Attorney, Agent, or Firm* — Fishman Stewart PLLC

(57) ABSTRACT

A controllable hydraulic oscillating slide machine includes an inner rotor arranged in a housing and having cylindrical recesses. A bearing is formed in the housing, in which a co-rotating outer rotor is mounted eccentrically to the inner rotor, the outer rotor having several pivotably suspended slide drivers that engage into the recesses of the inner rotor for rotationally driving the outer rotor by way of the inner rotor and form modifiable chambers. The slide drivers may each be coupled to a piston that is guided in a respective associated recess. A pressure level different from that in the chambers between the inner and the outer rotor may be set in the chambers delimited by the recesses and the associated pistons so that two different pressure levels may be generated and two different consumers can be supplied using the oscillating slide machine.

20 Claims, 3 Drawing Sheets

(51) Int. Cl.

| | |
|---|---|
| ***F04C 2/336*** | (2006.01) |
| ***F04B 23/12*** | (2006.01) |
| ***F04C 11/00*** | (2006.01) |

(56) References Cited

FOREIGN PATENT DOCUMENTS

| | | | |
|---|---|---|---|
| DE | 19532703 | C1 | 11/1996 |
| DE | 10155869 | A1 | 5/2003 |
| DE | 202006014416 | U1 | 2/2008 |
| DE | 102006016790 | B3 | 3/2008 |
| EP | 0848165 | A2 | 6/1998 |

OTHER PUBLICATIONS

English Machine Translation of DE10155869 A1 (translated on May 8, 2015).*

ISR for PCT/EP2011/052352.

* cited by examiner

OSCILLATING SLIDE MACHINE THAT PUMPS DIFFERENT FLUID MEDIUMS AT DIFFERENT PRESSURES

CROSS-REFERENCE TO RELATED APPLICATIONS

This application claims priority to German Patent Application No. 10 2010 009 471.4, filed on Feb. 26, 2010; German Patent Application No. 10 2010 014 137.2, filed on Apr. 7, 2010; German Patent Application No. 10 2010 024 222.5, filed on Jun. 18, 2010; and WIPO Application No. PCT/EP2011/052352, filed on Feb. 17, 2011, each of which are hereby incorporated by reference in their entirety.

TECHNICAL FIELD

The present invention relates to a controllable hydraulic oscillating slide machine according to the preamble of claim 1.

BACKGROUND

From DE 44 34 430 C2 a generic controllable hydraulic oscillating slide machine comprising an inner rotor arranged in a housing and having cylindrical recesses is known. Here, the inner rotor is rotatorically connected to an outer rotor by way of so-called slide drivers, which is mounted in a bearing designed as control housing. The known oscillating slide machine in this case is able to generate an exactly predefined pressure independent of rotational speed. Such an oscillating slide machine is usually employed for supplying bearing points in a combustion engine with lubricant.

SUMMARY

The present invention deals with the problem of stating an improved or at least an alternative embodiment for an oscillating slide machine of the generic type which is characterized in particular by an increased functionality.

According to the invention, this problem is solved through the subject of the independent claim 1. Advantageous embodiments are subject of the dependent claims.

The present invention is based on the general idea of designing a generic oscillating slide machine in such a manner that two different pressure levels can be made available with this oscillating slide machine and because of this a supply of at least two different consumers each with different pressure level is possible. With the oscillating slide machine according to the invention, a lubricant supply of a combustion engine in a motor vehicle with a first pressure level and at the same time a lubricant supply of a further consumer with a second pressure level and/or another medium is possible for example. To do so, it was necessary in the past either to provide two different lubricant pumps, i.e. oscillating slide machines, or adjust the second pressure level for example by way of a throttling device. The controllable, hydraulic oscillating slide machine according to the invention comprises an inner rotor arranged in a housing, which has cylindrical recesses (grooves). Here, so-called slide drivers engage in the recesses, which with their respective outer end are connected to the outer rotor for rotationally driving an outer rotor through the inner rotor and together with the inner rotor and the outer rotor form modifiable chambers. Here, the slide drivers are pivotably suspended in the recesses of the inner rotor as well as in corresponding recesses of the outer rotor. In addition to this, a control for modifying the eccentricity between the inner rotor and the outer rotor and thus to modify a maximum possible chamber volume can be provided, with the help of which the rate of delivery of the oscillating slide machine can be accurately set. It is now substantial to the invention that the slide drivers are each coupled to a piston which is guided in a respective associated recess of the inner rotor. Here, a different pressure level can be set in the chambers within the inner rotor delimited by the recesses and the associated pistons than in the chambers between the inner rotor and the outer rotor, as a result of which two different pressure levels can be generated and because of this two different consumers can also be supplied with the oscillating slide machine according to the invention. This is not possible with the oscillating slide machines known up to now and constitutes a substantial improvement of the functionality, since for realising two different pressure levels two oscillating slide machines or supplementary throttling devices are no longer necessary now, but the two pressure levels can be generated with the oscillating slide machine according to the invention. This is of special advantage in particular in motor vehicle construction, since there it is frequently demanded to supply different units with different lubricant pressures, wherein an available installation space in modern motor vehicles is usually so small that providing two different oscillating slide machines as lubricating pumps is not possible or only with difficulty so. Since the oscillating slide machine according to the invention does not require any increase in installation space compared with generic oscillating slide machines, the oscillating slide machine according to the invention can be employed in place of previous oscillating slide machines but offers the major advantage of being able to provide two different pressure levels. Providing these two different pressure levels is easily possible in terms of design in this case, so that the oscillating slide machine according to the invention does not produce any or merely little additional costs.

With an advantageous further development of the solution according to the invention, the individual slide drivers and the associated pistons are each coupled to one another by way of a roller-shaped joint head and a fork/pincer-shaped joint mounting. Such a joint head and an associated fork/pincer-shaped joint mounting allow an easily operable angulation between the slide driver and the associated piston, as a result of which a very easy operation of the oscillating slide machine can be achieved. In addition, such joint heads and joint mountings are able to transmit both compressive forces as well as tensile forces.

Further important features and advantages of the invention are obtained from the subclaims, from the drawings and from the associated Figure description by means of the drawings.

It is to be understood that the features mentioned above and still to be explained in the following cannot only be used in the respective combination stated but also in other combinations or by themselves, without leaving the scope of the present invention.

Preferred exemplary embodiments of the invention are shown in the drawing and are explained in more detail in the following description, wherein same reference characters relate to same or similar or functionally same components.

BRIEF DESCRIPTION OF THE DRAWINGS

Here it shows, in each case schematically.

DETAILED DESCRIPTION

Figure 1:
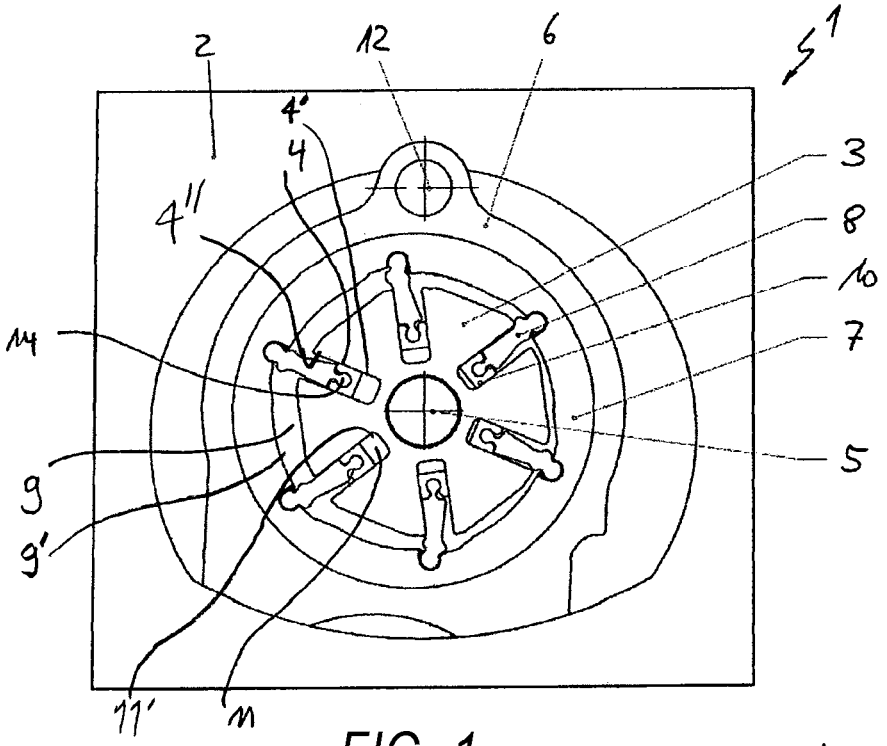
FIG. 1 a sectional representation through a first embodiment an oscillating slide machine according to the invention, FIG. 2 a representation as in FIG. 1 however with an alternative embodiment, FIG. 3 in a schematic, perspective representation a further configuration of an oscillating slide machine, FIG. 4 in a schematic, perspective detail representation at least partially a further configuration of an oscillating slide machine with slide drivers, wherein the slide drivers have rectangular pistons, and FIG. 5 in a schematic, perspective detail representation at least partially a further configuration of an oscillating slide machine with slide drivers, wherein the slide drivers have round pistons.
Figure 2:
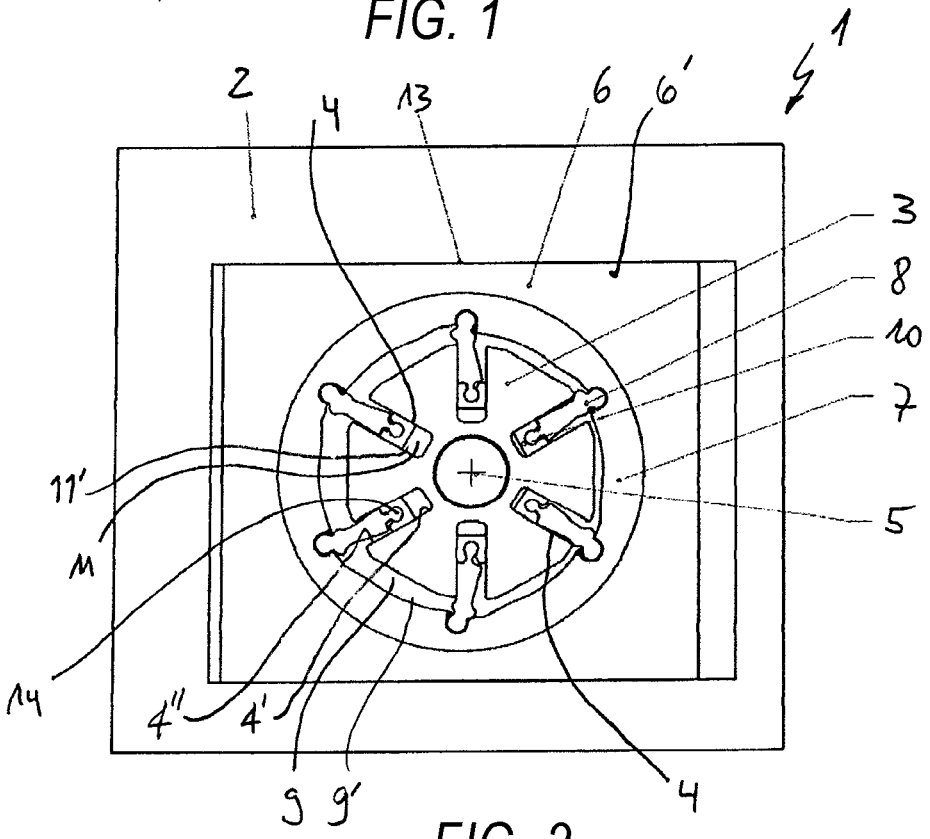

Referring to FIGS. 1 and 2, an exemplary controllable hydraulic oscillating slide machine 1 includes an inner rotor 3 arranged in a housing 2. Which includes recesses 4 (grooves) that are cylindrical however not round but cuboid in shape. As is evident from FIGS. 1 and 2 the inner rotor 3 in each case has six recesses 4, which are radially arranged. In general, the number of the recesses 4 however can be any. The inner rotor 3 is connected to a driveshaft 5 in a positive and/or non-positive manner, in particular in a rotationally fixed manner. With the housing, a bearing 6 is additionally provided in which a co-rotating outer rotor 7 is mounted eccentrically to the inner rotor 3. The outer rotor 7 includes a plurality of slide drivers 8 pivotably suspended in said outer rotor, which engage in the recesses 4 of the inner rotor 3 for the rotational driving of the outer rotor 7 by the inner rotor 3 and form modifiable chambers 9. During the rotary movement of the inner rotor 3 the chambers 9 modify their volume and because of this ensure a delivery flow, for example a lubricant delivery, insofar as the oscillating slide machine 1 is a lubricant pump or a motor vehicle oil pump. Here, the oscillating slide machine 1 generates a first pressure in the chambers 9.

Each one of the exemplary slide drivers 8 is coupled to a piston 10, which is in turn translatorically guided in an associated recess 4 of the inner rotor 3. In the chambers 11 delimited by the recesses 4 and the associated pistons 10 a pressure level other than that in the chambers 9 between the inner rotor 3 and the outer rotor 7 can be adjusted, so that with the exemplary oscillating slide machine 1, two different pressure levels can be generated and because of this two different consumers can be supplied. It is also conceivable in general that a medium 11' that is pumped through the chambers 11 may different from a medium 9' that is pumped through the chambers 9. According to FIG. 1 the bearing 6 in this case is a rotary slide and accordingly can be rotated about an axis 12. A rotation of the bearing 6 in this case causes a change of the eccentricity between the inner rotor and the outer rotor 7 and because of this a change of the rate of delivery of the oscillating slide machine 1. Alternatively to this, the bearing 6, as is shown for example according to FIG. 2 may be designed as a spherical bearing and can be configured to be a slide 6'.

In order to make possible as easy an operation of the oscillating slide machine 1 as possible, the slide drivers 8 and the associated pistons 10 are coupled to one another via a roller-shaped joint head 14 and a fork/pincer-shaped joint mounting, and this joint mounting is not only able to generate tensile and compressive forces, but also offset directional deviations between the piston 10 and the respective associated slide driver 8. Here, the recesses 4 in the inner rotor 3 can have an angular cross section 4' , which is normal to the axis of oscillation. Exemplary cross sections can include as a rectangular cross section 4" or cuboidal cross section.

The exemplary oscillating slide machine 1 also constitutes a substantial improvement with respect to an internal tightness, wherein the oscillating slide machine 1 can be operated quasi as tandem pump for two different pressure levels and/or media. This becomes possible in particular through the pistons 10 in the recesses 4 of the inner rotor 3 below the slide drivers 8, which are configured to at least minimize the inner leakage of the delivery medium from the chambers 11 to the chambers 9. Here it is obviously likewise possible to deliver a fluid or provide a corresponding pressure level merely by way of the chamber 9 or via the chambers 11.

An exemplary control of the oscillating slide machine 1 in this case is easily possible by rotating the bearing 6 as configured to be a pivot bearing shown in FIG. 1 or by sliding the bearing 6 as configured to be a slide shown in FIG. 2. However, it is likely to be of special advantage that with the oscillating slide machine 1, two different pressure levels can be generated and because of this two different consumers can be supplied, which was not possible with previous oscillating slide machines because of the leakage between the chambers 11 and the chamber 9. In this example, the oscillating slide machine 1 does not require any enlarged installation space so that it can be installed in the place of previous oscillating slide machines.

Figure 3:
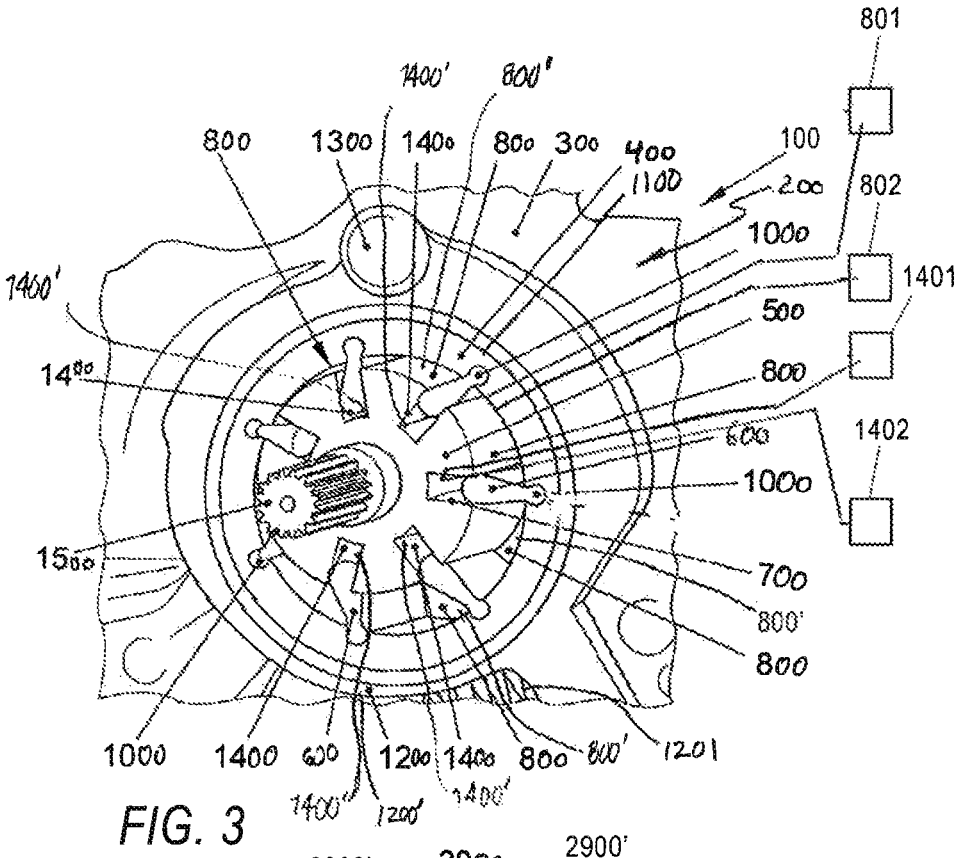
Figure 4:
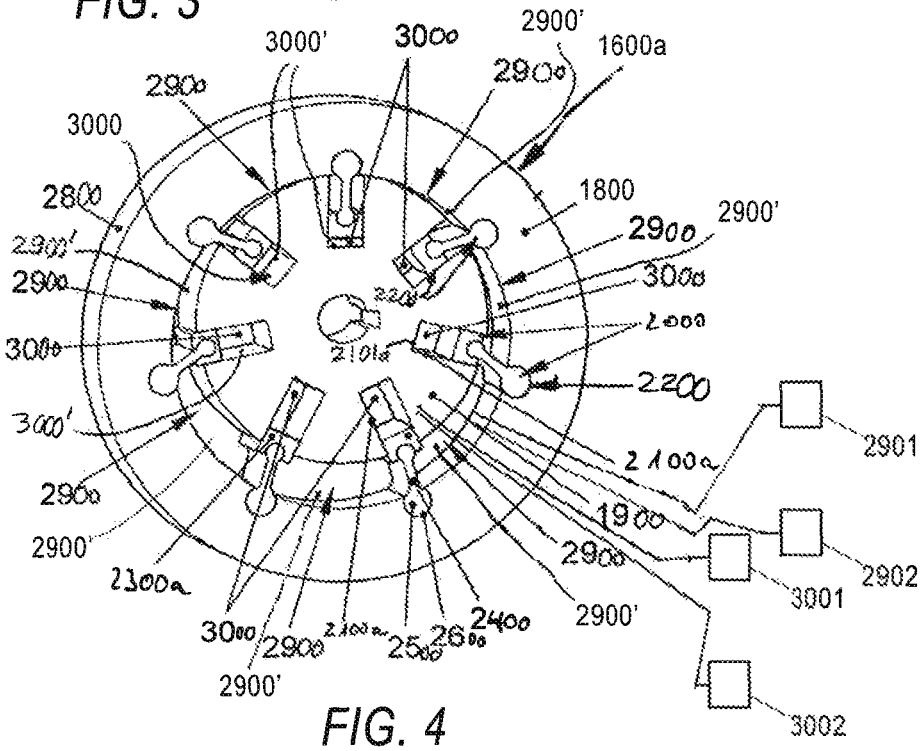
Figure 5:
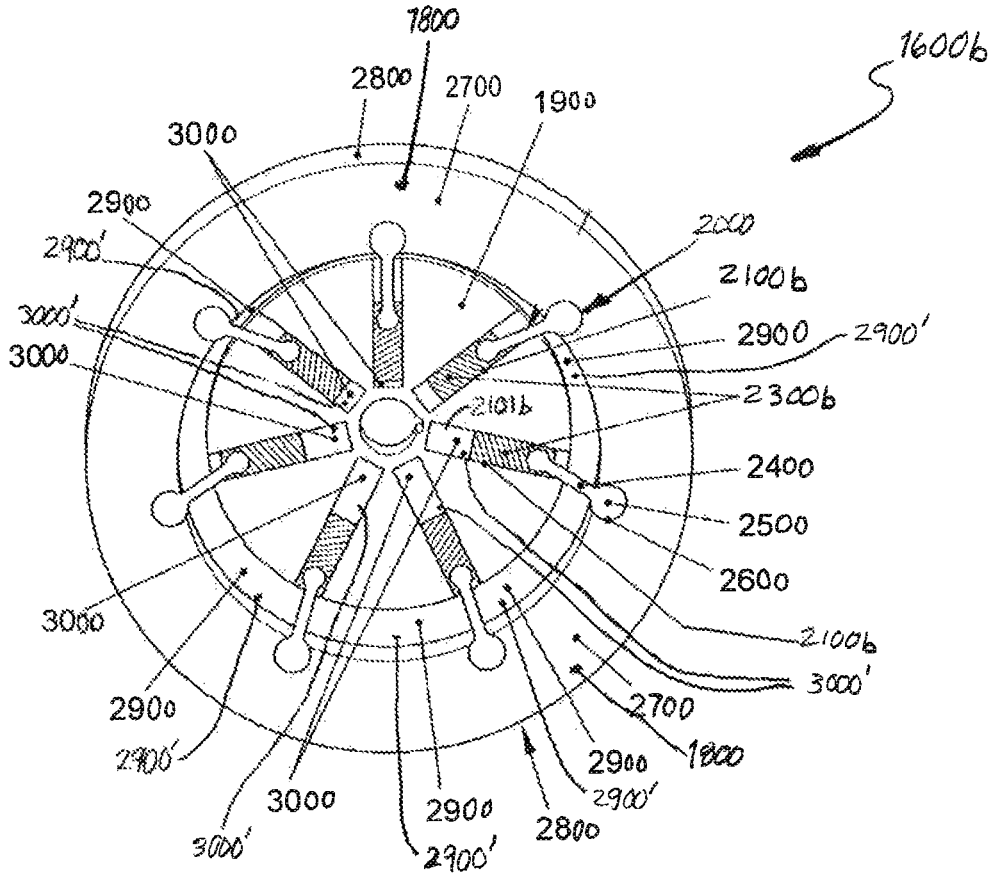

The following embodiments relate to FIGS. 3 to 5, wherein the oscillating slide machine 1 in this case is designated as rotary slide pumping device 100. Further concordant terms and reference characters are listed in the following table and can thus be synonymously used or replaced by one another and used in FIGS. 1 to 5:

| FIG. 1 and 2 | | FIG. 3 to 5 | |
|---|---|---|---|
| Term | Reference number | Term | Reference number |
| Oscillating slide machine | 1 | Rotary slide pumping device<br>Oscillating slide pump | 100, 1600a, 1600b, 200 |
| Housing | 2 | Housing | 300 |
| Inner rotor | 3 | Inner rotor | 500, 1900 |
| Recesses | 4 | Guide mounting | 700, 2100a, 2100b |
| Driveshaft | 5 | | |
| Bearing | 6 | Holding ring | 1200 |
| Outer rotor | 7 | Outer ring | 400, 1800 |
| | | Outer rotor | 1100, 2900 |
| Slide driver | 8 | Slide | 600, 2000 |
| | | Oscillating slide<br>Oscillating piston rod | 600, 2400 |
| Chamber | 9 | First working chamber | 800, 2900 |
| Piston | 10 | Piston | 2300a, 2300b |
| Chambers | 11 | Second working chamber | 1400, 3000 |
| Axis | 12 | Pivot axis | 1300 |
| Guide path | 13 | Guide mounting | 2100a, 2100b |
| Joint head | 14 | | |

The rotary slide pumping device 100 is connected to at least one hydraulic circuit 801 which serves for supplying an automatic or automated transmission (not shown) of a motor vehicle (not shown) with a pressure medium 800', in particular with an oil. The transmission in particular includes one or a plurality of friction clutches, which can be hydraulically actuated with shifting elements and/or the transmission includes further transmission components or shifting elements such as shifting sleeves or the like that have to be actuated. In particular, the transmission can be embodied as double clutch transmission having two friction clutches. For example, the friction clutches can be wet-operating friction clutches. The friction clutches are cooled by the oil. The use of dry clutches is also conceivable with a transmission, this is dependent on the respective embodiment. In this example, the rotary slide pumping device 100 is an oscillating slide pump 200. The oscillating slide pump 200 includes a housing 300. Within the housing 300, an outer ring 400 is arranged. The rotary slide pumping device 100 further has an inner rotor 500, which is rotatably mounted and can be driven in a functionally effective manner by a motor that is not shown. The inner rotor 500 can be driven in particular by an electric motor. Alternatively, the inner rotor 500 can be driven in a functionally effective manner by an engine of the motor vehicle. The inner rotor 500 is arranged within the outer ring 400. The outer ring 400 is eccentrically arranged or can be eccentrically arranged relative to the inner rotor 500. The outer ring 400 is preferentially arranged displaceably or rotatably relative to the inner rotor 500.

The rotary slide pumping device 100 furthermore includes a plurality of slides 600. The slides 600 are arranged or can be arranged between the outer ring 400 and the inner rotor 500. The slides 600 extend between the outer ring 400 and the inner rotor 500. The inner rotor 500 includes a plurality of guide mountings 700. The guide mountings 700 substantially extend in radial direction. Within the guide mountings 700, the slides 600 are guided. The width of the slides 600 is at least partially adapted to the width of the guide mounting 700. The slides 600 in this case are oscillatingly guided in the guide mountings 700. A plurality of first working chambers 800 are delimited by the outer ring 400 and by the inner rotor 500 as well as by the slides 600.

FIG. 3 shows a configuration of the rotary slide pumping device 100, wherein seven slides 600 and thus seven first working chambers 800 are provided. In an alternative configuration, more or fewer than seven first working chambers 800 can be provided. The first working chambers 800 are arranged between the inner rotor 500 and the outer ring 400. The slides 600 delimit the respective first working chambers 800, which in part are arranged adjacent to one another. The slides 600 and thus also the first working chambers 800 co-rotate with the inner rotor 500. The guide mountings 700 are preferentially spaced identically on the circumference. The slides 600 are guided radially displaceably in the guide mountings 700. The guide mountings 700 can be embodied as slits or bores (not designated in more detail). The guide mountings 700 can be embodied in particular as slits which are open at the edge on the face end. Furthermore, the slides 600 are embodied as slide drivers, wherein the slide drivers 600 are pivotably mounted on the outer ring 400. The slide drivers 600 are furthermore pivotably mounted in the guide mountings 700. Each one of the slide drivers 600 has a head 1000, and the head 1000 is pivotably mounted on the outer ring 400. The head 1000 is rotatably mounted on the outer ring 400 in a functionally effective manner. The head 1000 has a part-cylindrical surface (not designated in more detail) or a cylinder segment area. The slide drivers 600 are therefore pivotably mounted on the outer ring 400, in particular with the head 1000. The slide drivers 900 in this case are substantially embodied conically, and a foot region (not designated in more detail) of the slide drivers 600 has corresponding spherical segment areas or two opposing cylindrical segment areas, so that the slide driver 600 is pivotably mounted in the guide mountings 700, thus the slide driver 600 in this case is not rigidly attached to the inner rotor 500.

The exemplary outer ring 400 is an outer rotor 1100, and the outer rotor 1100 is rotatably mounted in a holder 1200, which in this form is a bearing. The holder 1200 is preferentially arranged in a displaceable manner together with the outer rotor 1100, so that the outer rotor 1100 together with the holder 1200 is displaceable relative to the inner rotor 500. Because of this, the dimension of the eccentricity of the inner rotor 500 relative to the outer rotor 1100 is adjustable. Here, the holder 1200 can be pivoted about a pivot axis 1300, wherein by pivoting the holder 1200 about the pivot axis 1300, the relative position of the outer ring 400 and of the outer rotor 1100 to the inner rotor 400 can be adjusted. The first working chambers 800 can pump a pressure medium 800', in particular, a pressure medium 800'can flow in and flow out here, in particular as a function of the current position feeding and discharge openings. The first working chambers 800 are therefore usable for changing the pressure of the pressure medium 800'. A first hydraulic circuit can be supplied with the first working chambers 800. In particular, the first hydraulic circuit can be a low-pressure hydraulic circuit 801 that serves to supply a lubricant and cool the friction clutch (ES) with the pressure medium 800', in particular with an oil or for lubricating/cooling other transmission components. In addition to this, a spring device 1201 can be provided, which preloads the spherical bearing 1200' in a direction, which in turn determines a certain volume of the first working chambers 800.

The disadvantages mentioned at the outset are now avoided in that the guide mountings 700 and the slides 600 delimit a second working chamber 1400, wherein the second working chamber 1400 can be subjected to the through-flow of the pressure medium and the second working chamber 1400 can be used for changing the pressure and/or delivering the pressure medium.

This has the advantage that with the second working chambers 1400 a second hydraulic circuit 1401 can be supplied. The first hydraulic circuit can be used in particular as low-pressure hydraulic circuit 801 for supplying the friction clutches with lubricating oil. In this example, the second hydraulic circuit 1401 can be a high-pressure hydraulic circuit for supplying the shifting elements of the transmission. The volumetric change of the first working chamber 800 is greater than the volumetric change of the second working chamber 1400 during the operation of the rotary slide pumping device 100. The pressure change realised by the second working chamber 1400 is greater than the pressure change realised by the first working chamber 800. The size of the second working chambers 1400 is substantially determined by the stroke of the slides 600 and the cross section of the guide mountings 700. Through a suitable selection of the size of the guide mountings 700, the displacement volume/delivery volume realised by the second working chamber 1400 can be determined. The generatable volumetric flow in the first working chamber 800 is substantially determined by the size and the eccentricity of the outer ring 400 relative to the inner rotor 500. Since the second working chambers 1400 are provided within the inner rotor 500, the pressure levels/delivery volumes that can be tapped off the second working chamber 1400 are better adapted to the required pressure level for supplying the shifting elements of the transmission. The first working chambers 800 are completely available for supplying the friction clutch with the pressure medium. Here, the pressure medium serves as cooling oil/lubricating oil. Upon a rotation of the inner rotor 500, the first working chambers 800 and the second working chambers 1400 are periodically increased and reduced in size. Because of this, a defined volumetric flow can be generated in the first and second working chambers 800, 1400. The first and second working chambers 800 and 1400 shown on the right-hand side of FIG. 3 in this case have a large volume, and the first and second working chambers 800 and 1400 shown on the left-hand side of FIG. 3 have a small volume, since the inner rotor 500 in this case is positioned near the outer ring 400 and the slides 600 are thus pushed in deeply into the guide mountings 700. The first working chambers 800 are connected in a functionally effective manner in particular to a motor vehicle cooling oil supply. The second working chambers 1400 are each connected in particular to a high-pressure hydraulic circuit for actuating one or a plurality of shifting elements of the transmission. The pressure medium 800' for the first working chamber 800 is preferentially drawn in from a first pressure medium reservoir 802 and the pressure medium 1400' for the second working chamber 1400 is preferentially drawn in from a second pressure medium reservoir 1402. The displacement volume and therefore the rate of delivery per revolution are obtained from the displacement in the first working chamber 800 between the inner rotor 500 and the outer rotor 400 and via the stroke of the slides 600 in the guide mountings 700 or from the displacement in the second working chamber 1400. The first working chambers 800 are preferentially supplied from the outside (radially or axially). The first working chambers 800 can be supplied with the pressure medium through the outer ring 400 with pressure medium lines which are not shown or the pressure medium can be discharged by way of the pressure medium lines. The second working chambers 1400 within the inner rotor 500 can be preferentially supplied from the inside and supplied and discharged via a hollow bearing pin 1500. Alternatively, the second working chambers 1400 can be supplied axially, in particular insofar as the guide mountings 700 are open on the face end. With the preferred embodiment, the second working chambers 400 however are also supplied substantially radially. In the following, reference can be made to FIGS. 4 and 5: since the configurations in FIGS. 4 and 5 are similar, substantially corresponding components are provided with same reference characters. FIGS. 4 and 5 partially show two examples of a rotary slide pumping device 1600*a* and 1600*b* respectively.

The exemplary rotary slide pumping devices 1600*a* and 1600*b* are oscillating slide pumps . A housing and a holder are not shown in FIG. 2. The oscillating slide pumps 1600*a*, 1600*b* include an outer ring 1800, an inner rotor 1900 and a plurality of slides 2000. The inner rotor 1900 in turn includes a plurality of guide mountings 2100*a* (see FIG. 4) and a plurality of guide mountings 2100*b* (see FIG. 5), wherein the slides 2000 are guided in the corresponding guide mountings 2100*a* or 2100*b*. The guide mountings 2100*a* (see FIG. 4), in this example, are slits (not designated in more detail). More specifically, the guide mountings 2100*a* can be slits that are open at the edge on the face end. In particular, the cross section of the guide mountings 2100*a* is angular, and in this example the cross section of the guide mountings 2100*a* is rectangular. The exemplary guide mountings 2100*b* (see FIG. 5) are bores (not designated in more detail). The guide mountings 2100*b* are embodied axially closed in the inner rotor 1900. The guide mountings 2100*b* are closed axially or at the face end, so as to be a blind bore. In particular, the cross section of the guide mountings 2100*b*, as disposed normal to the axis of oscillation, is round, substantially circular.

The outer ring 1800, in this example, is an outer rotor 2700. The outer rotor 1800 has an outer circumferential surface 2800, wherein the outer rotor 1800 with the outer circumferential surface 2800 is rotatably mounted in a corresponding holder (not shown, but see FIG. 3). In this example, the slides 2000 are slide drivers, and the slide drivers 2000 are pivotably mounted on the outer rotor 1800, thus the slide drivers 2000 are not rigidly attached to the outer rotor 1800. Continuing with the two examples shown in FIGS. 4 and 5, the slide drivers 2000 include a piston 2300*a* (FIG. 4) and a piston 2300*b* (FIG. 5), and the pistons 2300*a*, 2300*b* are guided in a respective one of the guide mounting 2100a (FIG. 4) and the guide mounting 2100*b*. The cross section of the pistons 2300*a*, 2300*b* is adapted to a respective one of the cross sections of the guide mountings 2100*a*, 2100*b* or corresponds to the cross section of the guide mountings 2100*a* Furthermore, each one of the slide drivers 2100 has an oscillating piston rod 2400, wherein the oscillating piston rod 2400 is pivotably mounted on the piston 2300*a*. The oscillating piston rod 2400 is furthermore rotatably mounted on the outer ring 1800 in a functionally effective manner. Each one of the oscillating piston rods 2400 has a head 2500, wherein the head 2500 is mounted in a bearing mounting 2600 in the outer ring 1800. The bearing mounting 2600 is opened towards the inner circumferential surface of the outer ring 1800 not designated in more detail. The outer ring 1800 is arranged eccentrically relative to the inner rotor 1900. The rotary slide pumping device 1600*a* and 1600*b* respectively includes a plurality of working chambers 2900. Altogether, seven slide drivers 2000 and thus also seven first working chambers 2900 are provided. The first working chambers 2900 are delimited by the outer ring 1800, the inner rotor 1900 and the slides 2000. The first working chamber 2900 can be subjected to a pressure medium through-flow. The first working chamber 2900 can be used for changing the pressure of the pressure medium. The first working chamber 2900 can be connected to a first hydraulic circuit of an automatic transmission (not shown). The first working chambers 2900 can be supplied with a pressure medium via pressure lines that are not shown.

For example, the connections for directing and passing on the pressure medium can also be arranged axially to the first working chamber 2900. The disadvantages mentioned at the outset are now avoided in that the guide mountings 2100*a*, 2100*b* and the slides 2000 delimit a second working chamber 3000, wherein the second working chamber 3000 can be subjected to a through-flow of the pressure media and the second working chamber 3000 can be used for changing the pressure and/or delivering the pressure medium. The pressure change that is realised with the help of the second working chamber 3000 is preferentially greater than the pressure change realised by the first working chamber 2900. The volumetric change of the first working chamber 2900 in this case is greater than the volumetric change of the second working chamber 3000 during the rotation of the inner rotor 1900 relative to the outer ring 1800. The first working chamber 2900 can in particular be connected to a low-pressure hydraulic circuit of the transmission. The second working chamber 3000 can be connected to a high-pressure hydraulic circuit for actuating at least one shifting element of the transmission.

As has already been described in the configuration represented in FIG. 3 the outer ring 1800 can be displaceably arranged relative to the inner rotor 1900. Because of this, the rate of delivery of the first working chamber 2900 and of the second working chamber 3000 is adjustable. The volumetric change during a rotation of the inner rotor of the first working chambers 2900 and of the second working chambers 3000 is dependent on the eccentricity of the inner rotor 1900 relative to the outer ring 1800. In the configuration represented in FIG. 4, the pistons 2300*a* are configured to be rectangular pistons. In the configuration represented in FIG. 5, the pistons 2300*b* are configured to be round pistons. Again, the cross sections of piston 2300*a*,2300*b* are adapted to a respective cross section of guide mountings 2100*a*, 2100*b*. Thus, in one example as shown in FIG. 4, the exemplary rectangular pistons 2300*a* are adapted to a corresponding rectangular cross section 2101*a* of the guide mountings 2100*a*. In another example as shown in FIG. 5, the exemplary round pistons 2300*b* are adapted to a corresponding round cross section 2101*b* of the guide mountings 2100*b*.

A leakage between the high-pressure region of the second working chamber 3000 and low-pressure region of the first working chamber 2900 can be reduced or minimised in particular through the double rotatable mounting of the slide driver 22 or of the oscillating piston rod 2400 in combination with the pistons 2300*a*, 2300*b*. The embodiment with round pistons in FIG. 5 has the advantage that the drag moment is reduced. The face-end sealing of the first working chambers 2900 is preferentially effected in that the face-end pump housings not shown in more detail are pressed together with a high axial force. Through the guidance of the pistons 2300*a*, 2300*b* within the inner rotor 1900, as is shown in FIG. 5, the second working chamber 3000 is already delimited on the face end through the inner rotor 1900. Because of this, no high axial preload during the pressing together of the face-end pump housing is necessary. The advantage of using a oscillating slide pump 200, 1600*a*, 1600*b* (see FIGS. 3 to 5) is that suction is possible from two separate pressure medium reservoirs. The slide drivers 600, 2000 are pivotably mounted in the outer rotor 1100, 1800. The mechanical friction within the rotary slide pumping device 100, 1600*a*, 1600*b* is reduced through the design as oscillating slide pump 200. Because of this, the component of the drive energy that is used for driving the rotary slide pumping device 100, 1600*a*, 1600*b* and the oscillating slide pump 200, is minimised. The rotary slide pumping devices 100 and 1600*a*, 1600*b* can also be realised as rotary vane pump (not shown) in an alternative configuration. The slides designed as vanes in this case are not connected to the outer ring. The outer ring is not arranged in a co-rotating manner relative to the inner rotor. The vanes are radially guided in the guide mountings. The sealing of the first working chambers is effected in that the vanes are pressed if required against the inner circumferential surface of the outer ring with a sliding shoe or the like. Here, preferentially the first working chamber and the second working chamber are interconnected. The pressure from the displacement from the outer first working chamber is directed under the vanes in order to press the vanes against the outer ring during the start-up of the inner rotor, thus establishing a seal between the vanes and the outer ring.

With the help of the rotary slide pumping device according to the invention, different volumetric flows which are separated from one another can now preferentially be generated. On the one hand, for the cooling/lubrication of transmission and/or clutch components, high volumetric flows in particular can be realised with low pressures and on the other hand for the adjustment/actuation of shifting elements, low volumetric flows with high pressures can be realised. With the preferred embodiment of the rotary slide pumping devices according to FIG. 3 to 5 shown here, the first working chambers, in particular for geometrical reasons, are used for realising the cooling oil volumetric flow and the second working chambers for realising the volumetric flow for actuating the shifting elements. It is also conceivable that for example with another application a high pressure is requested with a high volumetric flow and a low pressure with a low volumetric flow, so that then a high-pressure hydraulic circuit could be supplied via the first working chambers and a low-pressure hydraulic circuit via the second working chambers. This is dependent on the respective application case and the specific embodiment of the rotary slide pumping device or its connection to respective further hydraulic components or hydraulic circuits.

Turning to a respective one of FIGS. 3 to 5, an exemplary oscillating slide machine can be a rotary slide pumping device (100, 1600*a*, 1600*b*). In particular, the pumping device can be configured for at least one hydraulic circuit (801, 2901) of an automatic or automated transmission of a motor vehicle having an outer ring (400, 1800), having an inner rotor (500, 1900) and having a plurality of slides (600, 2000). The outer ring (400, 1800) is eccentrically arranged relative to the inner rotor (500, 1900), wherein the slides (600, 2000) are arranged or can be arranged between the outer ring (400, 1800) and the inner rotor (500, 1900). In the inner rotor (500, 1900), a plurality of guide mountings (700, 2100*a*, 2100*b*) and the slides (600, 2000) are guided in the guide mountings (700, 2100*a*, 2100*b*), and a plurality of first working chambers (800, 2900) are delimited by the outer ring (400, 1800), the inner rotor (500, 1900) and the slides (600, 2000). The first working chambers (800, 2900) can be subjected to a pressure medium through-flow, and the first working chambers (800, 2900) can be used for changing pressure and/or delivery of the pressure medium. In this example, each one of the guide mountings (700, 2100*a*, 2100*b*) and the slides (600, 2000) delimit a second working chamber (1400, 3000). The second working chamber (1400, 3000) can be subjected to the pressure medium through-flow and the second working chamber (1400, 3000) can be used for changing the pressure and/or delivery of the pressure medium (1400', 3000').

Further alternative or cumulative features of the rotary slide pump according to the invention are:

- that the second working chamber (1400, 3000) is connected to a high-pressure hydraulic circuit (1401, 3001),
- that the pressure change realised by the second working chamber (1400, 3000) is greater than the pressure change realised by the first working chamber (800, 2900),
- that the volumetric change of the first working chamber (800, 2900) is greater than the volumetric change of the second working chamber (1400, 3000) upon a rotation of the inner rotor (500, 1900),
- that the first working chamber (800, 2900) is connected to a low-pressure hydraulic circuit (801, 2901), in particular for cooling oil supply of the automatic transmission,
- that the outer ring (400, 1800) is outer rotor (1100), wherein the outer rotor (1100) is rotatably mounted,
- that the outer ring (400, 1800) is displaceably arranged relative to the inner rotor (500, 1900),
- that the slides (600, 2000) are designed as slide drivers, wherein the slide drivers(600, 2000) are displaceably mounted on the outer rotor (1100, 1800), that the slide drivers (600, 2000) each have a piston (2300*a*, 2300*b*) and a oscillating piston rod (2400), wherein the piston (2300*a*, 2300*b*) is guided in the guide mounting (2100*a*, 2100*b*) and at least partially delimits the second working chamber (3000), wherein the oscillating piston rod (2400) is pivotably mounted on the piston (2300*a*, 2300*b*) and pivotably mounted on the outer rotor (1800) in a functionally effective manner,
- that the guide mounting (2100*b*) is embodied axially closed in the inner rotor (1900),
- that the piston (2300*a*, 2300*b*) is embodies as a piston element of a rectangular cross section or as a round piston with a substantially circular cross section,
- that the first working chambers (800, 2900) and the second working chambers (1400, 3000) are each connected to different hydraulic circuits (801, 2901), that the first working chambers (800, 2900) are connected to a low-pressure hydraulic circuit (801, 2901) and the second working chambers (1400, 3000) to a high-pressure hydraulic circuit (1401, 3001), that the pressure medium (800' ,2900') for the first working chambers (800, 2900) is drawn in from a first pressure medium reservoir (802, 2902) and the pressure medium (1400', 3000')for the second working chambers (1400, 3000) from a second pressure medium reservoir (1402, 3002)or suitably separated different pressure medium reservoirs are provided.

that the pressure medium (800', 2900')for the first working chambers (800, 2900) is drawn in from a first pressure medium reservoir (802, 2902) and the pressure medium (1400', 3000') for the second working chambers (1400, 3000) from a second pressure medium reservoir (1402, 3002) or suitably separated different pressure medium reservoirs are provided.

The invention claimed is:

1. A controllable hydraulic oscillating slide machine comprising:

an inner rotor arranged in a housing which comprises a plurality of cylindrical recesses;

a bearing formed in the housing;

an outer rotor positioned between the bearing and the inner rotor, the outer rotor is mounted and co-rotates eccentrically to the inner rotor, and the outer rotor comprises a plurality of pivotably suspended slide drivers, which engage into the plurality of recesses of the inner rotor for rotationally driving the outer rotor by way of the inner rotor;

wherein each one of the plurality of slide drivers is pivotably attached to an associated piston of a plurality of pistons, and wherein each associated piston of the plurality of pistons is in turn guided in a respective one of the plurality of recesses of the inner rotor;

a plurality of first working chambers delimited by the outer rotor, the inner rotor and the slide drivers, and the plurality of first working chambers are a plurality of modifiable chambers configured to modify a volume in a respective one of the modifiable chambers, such that the plurality of first working chambers deliver an exit flow of a first pressure medium at a first pressure level;

a plurality of second working chambers fluidically separated from the plurality of first working chambers and delimited by the plurality of recesses and the plurality of pistons, such that the plurality of second working chambers deliver another exit flow of a second pressure medium at a second pressure level, and wherein the plurality of first working chambers and the plurality of second working chambers, respectively, are configured to at least one of (i) deliver the exit flows at the first pressure level and the second pressure level in which the second pressure level is a different pressure level from the first pressure level and (ii) pump the first pressure medium and the second pressure medium, the second pressure medium being a different level of pressure from the first pressure medium;

wherein each associated piston of each slide driver of the plurality of slide drivers fluidically separates a first working chamber of the plurality of first working chambers from a second working chamber of the plurality of second working chambers.

2. The oscillating slide machine according to claim 1 wherein the bearing is at least one of a pivot bearing and a slide bearing, and at least one of the pivot bearing and the slide bearing is configured to move so as to change the eccentricity between the inner rotor and the outer rotor such that a rate of delivery of the oscillating slide machine is changed.

3. The oscillating slide machine according to claim 2 wherein when the slide bearing is selected the slide bearing is a spherical bearing.

4. The oscillating slide machine according to claim 3 wherein each slide driver of the plurality of slide drivers is attached to an associated piston of the plurality of pistons via a roller-shaped joint head and a fork/pincer-shaped joint mounting.

5. The oscillating slide machine according to claim 1 wherein each slide driver of the plurality of slide drivers is attached to an associated piston of the plurality pistons via a roller-shaped joint head and a fork/pincer-shaped joint mounting.

6. The oscillating slide machine according to claim 1, wherein each recess of the plurality of recesses has a round cross section normal to the axis of piston oscillation.

7. The oscillating slide machine according to claim 1, wherein a spring device is provided, which preloads the bearing in a direction.

8. The oscillating slide machine according to claim 1, wherein the oscillating slide machine is a motor vehicle oil pump.

9. The oscillating slide machine according to claim 1, wherein the plurality of slide drivers of the oscillating slide machine comprises six slide drivers.

10. The oscillating slide machine according to claim 1, wherein the volumetric change of the plurality of first working chambers is greater than the volumetric change of the plurality of second working chambers upon a revolution of the inner rotor.

11. The oscillating slide machine according to claim 10, wherein the plurality of first working chambers is connected to a low-pressure hydraulic circuit.

12. The oscillating slide machine according to claim 10, wherein each recess of the plurality of recesses is a guide mounting that is a blind bore.

13. The oscillating slide machine according to claim 12 wherein at least one slide driver of the plurality of slide drivers comprises an oscillating piston rod, wherein the piston is guided in the guide mounting and at least partially delimits the second working chamber, wherein the oscillating piston rod is pivotably mounted on the piston and pivotably mounted on the outer rotor.

14. The oscillating slide machine according to claim 10 wherein the first pressure medium for the plurality of first working chambers is drawn in from a first pressure medium reservoir and the second pressure medium for the plurality of second working chambers is drawn in from a second pressure medium reservoir, the first pressure medium reservoir being separate and different from the second pressure medium reservoir.

15. The oscillating slide machine according to claim 10, wherein the first working chamber is connected to a low-pressure hydraulic circuit, and wherein each recess of the plurality of recesses is a guide mounting that is a blind bore.

16. The oscillating slide machine according to claim 15 wherein at least one slide driver of the plurality of slide drivers comprises an oscillating piston rod, wherein the piston is guided in the guide mounting and at least partially delimits the second working chamber, wherein the oscillating piston rod is pivotably mounted on the piston and pivotably mounted on the outer rotor.

17. The oscillating slide machine according to claim 16 wherein the first pressure medium for the plurality of first working chambers is drawn in from a first pressure medium reservoir and the second pressure medium for the plurality of second working chambers is drawn in from a second pressure medium reservoir, the first pressure medium reservoir being separate and different from the second pressure medium reservoir.

18. The oscillating slide machine according to claim 15 wherein the first pressure medium for the plurality of first working chambers is drawn in from a first pressure medium reservoir and the second pressure medium for the plurality of second working chambers is drawn in from a second pressure medium reservoir, the first pressure medium reservoir being separate and different from the second pressure medium reservoir.

19. The oscillating slide machine according to claim 1 wherein each piston of the plurality of pistons is a round piston having a substantially circular cross section to the axis of piston oscillation.

20. The oscillating slide machine according to claim 1, wherein each recess of the plurality of recesses is a guide mounting that is a blind bore.

* * * * *